United States Patent [19]

Jennings

[11] 4,050,600

[45] Sept. 27, 1977

[54] CONTAINER SPILLAGE PREVENTION SYSTEM

[76] Inventor: Martin C. Jennings, Rte. 1, Box 112, Port Deposit, Md. 21904

[21] Appl. No.: 696,262

[22] Filed: June 15, 1976

[51] Int. Cl.[2] ..... A61J 9/00

[52] U.S. Cl. ..... 215/11 R; 215/227; 248/102

[58] Field of Search ..... 215/11 R, 11 C, 227; 248/102, 105; 128/359; D9/261; D83/8 C

[56] References Cited

U.S. PATENT DOCUMENTS

| | | | |
|---|---|---|---|
| 1,913,531 | 6/1933 | Block | 215/11 R |
| 2,001,989 | 5/1935 | Theuerkauf | 215/11 R X |
| 2,033,296 | 3/1936 | Porter | 248/102 |
| 2,706,571 | 4/1955 | Ryan | 215/11 C X |
| 3,405,829 | 10/1968 | Siravo | 215/11 R X |
| 3,512,301 | 5/1970 | Kramer | 215/11 C UX |

*Primary Examiner*—Donald F. Norton
*Attorney, Agent, or Firm*—Morton J. Rosenberg

[57] ABSTRACT

A container spillage prevention system for preventing the leakage or spilling of liquid contained within a bottle through a nipple opening when the bottle is positionally located on a substantially horizontal surface. The spillage prevention system may also be used as a toy device which provides for a teething ring for a child. Additionally, the system has a contamination resistant feature such that the nipple of the bottle is positionally displaced from the surface upon which the bottle is resting to negate the possibility of continued contact of the nipple with a contaminated surface. The container spillage prevention system includes a cap member which engages the neck portion of a bottle where the cap has an opening through which the nipple may be mounted. A ring element is secured to a lateral wall of the cap member having dimensions such that an acute angle is formed between a peripheral surface of the bottle and the substantially horizontal surface upon which it is in contact.

8 Claims, 5 Drawing Figures

FIG. 1
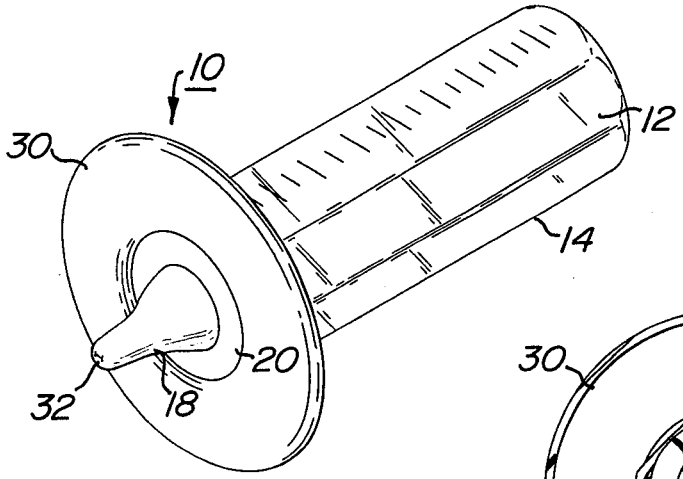
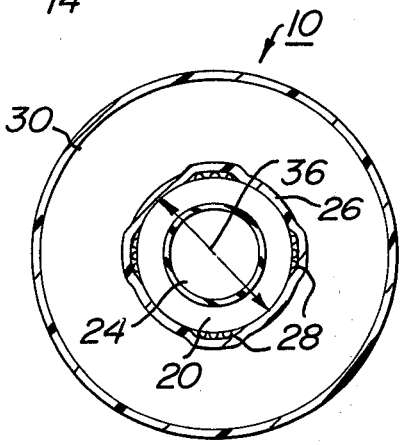
FIG. 3
FIG. 2
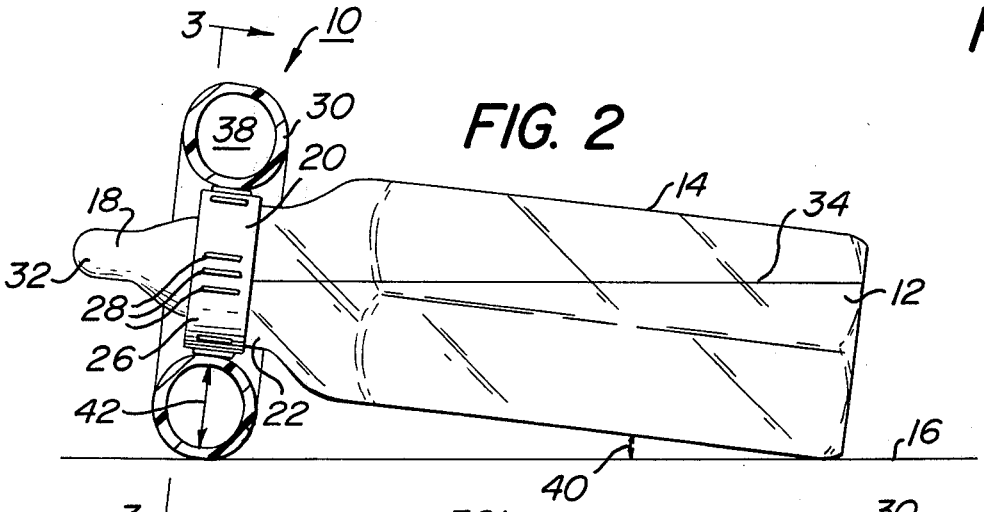
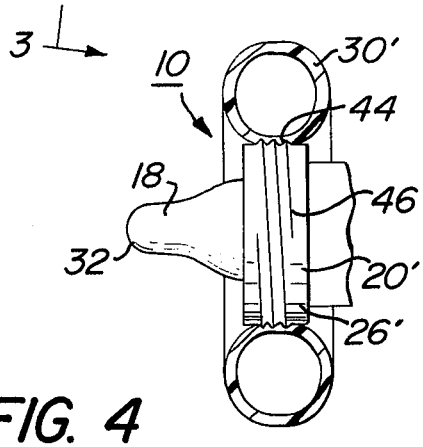
FIG. 4
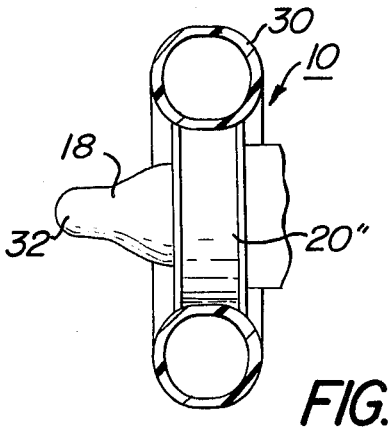
FIG. 5

CONTAINER SPILLAGE PREVENTION SYSTEM

BACKGROUND OF THE INVENTION

1. Field of the Invention

This invention pertains to container spillage prevention systems. In particular, this invention relates to a spillage prevention system which elevates the dispensing end of a bottle above the plane of a surface upon which the bottle is resting. Still further, this invention relates to a combination of a cap member and a ring member of predetermined diameter which are attached to the neck portion of a bottle. Still further, this invention relates to a system which may be utilized in combination as a teething ring for a child. More in particular, this invention pertains to a contamination minimizing system whereby a nipple of a baby bottle is maintained in displaced relation to a horizontal surface upon which the bottle is located and thus prevents contamination of the nipple. Still further, this invention relates to a shock resistant system which absorbs and disperses impact loading forces to prevent such from breaking or otherwise damaging a baby bottle to which the system is attached.

2. Prior Art

Baby bottles for dispensing liquid or other material contained therein are well known in the art. However, in some such prior art baby bottles, when the bottle was dropped or otherwise positioned on a horizontal surface, the liquid had a tendency of being spilled, leaked, or otherwise dispensed unwantingly through the nipple opening. This had a derogatory effect in that where some liquid, for example, milk, was inadvertently dispensed, such would cause bacteria growth and possibly be disadvantageous to a child's health as well as causing additional work in cleaning up such unwanted spillage.

In some prior baby bottles, the child would become distracted and try to play with the bottle itself. However, there was no toy-like mechanism attached to the baby bottle in order that the child could amuse himself or herself. Thus, in some prior cases, the child would try to bite on the bottle and due to the fact that the bottle is brittle, the child may have caused some injury to itself.

Still further, in general, prior baby bottles were formed entirely of a brittle material such as glass. When the bottle was dropped, even though most baby bottles are made of safety glass, if the impact load was high enough, the bottle would be damaged through cracking or some like derogatory effect. Thus, in such prior bottles there was no mechanism for absorbing any of the impact loads provided by an instantaneous or substantially instantaneous impact loading of the bottle surface.

Still further in prior baby bottles, there was no mechanism for maintaining the nipple portion out of contact with the surface upon which it was resting. This in some cases had the effect of allowing contaminates to impinge and be maintained on the nipple surface. These contaminates may have had derogatory effects on the health of the child.

SUMMARY OF THE INVENTION

A container spillage prevention system for material within the container. The spillage prevention system includes a cap member which is adapted to matingly engage the container adjacent an open end of the container. The cap member has a through opening for securement thereto of a material dispensing element. The container spillage prevention system further includes a mechanism for elevating the material dispensing element a predetermined distance above a substantially horizontal surface and the elevation mechanism is secured to the cap member.

BRIEF DESCRIPTION OF THE DRAWINGS

FIG. 1 is a perspective drawing of the container spillage prevention system secured to a bottle;

FIG. 2 is an elevation view of the container spillage prevention system where the bottle is lying on a substantially horizontal surface;

FIG. 3 is a sectional view of the container taken along the section lines 3—3 of FIG. 2;

FIG. 4 is an embodiment of the container spillage prevention system showing an elevation view of a threaded securement between a cap member and the elevation mechanism; and FIG. 5 is a further embodiment of the container spillage prevention system showing in elevation view a snap-fit between a cap member and a deformable toroidal ring member.

DESCRIPTION OF THE PREFERRED EMBODIMENTS

Referring now to FIGS. 1–3, there is shown container spillage prevention system 10 for maintaining material 12 internal to container or bottle 14 when it is dropped or otherwise positionally located on a substantially horizontal surface 16 as is shown in FIG. 2. Additionally, container spillage prevention system 10 is utilized to prevent contamination of material dispensing element or nipple 18 when bottle 14 is positionally located on the horizontal surface 16. As will be seen in following paragraphs, spillage prevention system 10 maintains nipple 18 in a displaced location from surface 16 in order that nipple 18 does not contact surface 16 and thus prevents contamination of dispensing elements 18 by germs, dirt and other contaminates that may have a derogatory effect when inserted into the mouth of a human. Still further, system 10 is designed to provide use as a toy wherein such may be utilized as a teething ring. Particular construction material of spillage prevention system 10 also allows system 10 to be used as a shock resistant member to absorb impact loads when bottle or container 14 is dropped through a distance onto a substantial surface 16 thereby minimizing the possibility of bottle 14 breaking or otherwise being damaged.

System 10 includes cap member 20 which is adapted to matingly engage bottle 14 adjacent open end 22 as is shown in FIGS. 1 and 2. Cap member 20 is generally mated to open end 22 of bottle 14 through threaded engagement or some like technique not important to the inventive concept as herein described. Additionally, cap 20 may be formed of a plastic material which is non-toxic, or of some like material well known in the art. Cap member 20 is generally cup-shaped in contour and includes through opening 24 formed through a base of member 20 in order to permit releasable securement of nipple 18 to cap member 20. Thus, cap member 20 is releasably secured to bottle 14 throughout an inner surface of lateral wall 26. Additionally, nipple or material dispensing element 18 is passed through opening 24 and engages cap member 20 on the base surface thereof through interfit of a standard flange section or element well known in the art.

System 10 further includes elevation mechanism or ring element 30 for elevating material dispensing element or hipple 18 a predetermined distance above substantially horizontal surface 16 in order that liquid or other material 12 is not easily dispensed through nipple opening 32. Ring 30 is secured to cap member 20 in a manner to be further described in following paragraphs and operates substantially as shown in FIG. 2 whereby liquid level 34 is positionally located below nipple opening or slit valve 32 to prevent dispensing of liquid 12 from within bottle 14.

As is seen in FIGS. 2 and 3, cap member 20 may include a series of extension members 28 providing for radial extensions of cap 20. Elevation mechanism 30 includes ring internal diameter 36 substantially equal to but, slightly less than the external diameter of cap member 20. Thus, ring element 30 may be secured to cap 20 through mating engagement in a force fit manner contiguous to lateral wall 26. As will be seen, ring element 30 may be made of pliable or deformable material such as plastic or some like material in order that slight deformations may be provided. Extension members 28 generally used for friction gripping of cap member 20 may in this case be utilized to provide additional deformation of ring element 30 to maintain ring element 30 in a tightened, but releasable secured member to cap member 20.

As is shown in FIGS. 1–5, ring member 30 may be toroidal in geometric contour having an internal diameter approximately equal to, but slightly less than the external diameter of cap member 20 as has hereinbefore been described. Ring member 30 may include a flexible wall section having an interal toroidal chamber 38 filled with air or some like medium to provide compressibility characteristics if system 10 including container 14 were dropped or otherwise impact loaded. As is evident from FIG. 2, the radius of cap member 30 plus the toroidal diameter of ring element 30 must in summation be greater than the radius of bottle or container element 14 in order that when container 14 is positionally located as shown in FIG. 2, that inclined angle 40 be acute in nature and greater than zero degrees. Although not important to the inventive concept as is herein described, various toroidal diameters have been successfully utilized to provide inclined angles 40 of between approximately 10°–35°. Toroidal diameter 42 of ring element 30 may be of a number of sizes, however, when taken in combination with the fact that system 10 is also adaptable to be utilized as a teething ring by babies, it has been found that optimum sizes of ring member 30 are determined by a toroidal diameter 42 of between approximately 1.0 – 1.5 inches.

Additionally, spillage prevention system 10 is utilizable as a contamination preventing mechanism whereby nipple 18 is maintained out of contact with surface 16 when bottle 14 is dropped or otherwise positionally located as shown in FIG. 2. Thus, although nipple 18 may momentarily interface with surface 16, after a stabilized position has been reached, nipple 18 will be substantially removed in positional displacement from surface 16 to provide a contamination-free environment. It will be understood that as shown in FIGS. 1, 2 and 3, ring member 30 may be removed from cap member 20 in order that both cap member 20 and elevation device 30 may easily be cleaned and then replaced in interfacing engagement with respect to each other.

As has hereinbefore described, ring member 30 is formed of a pliable material such as plastic or some like composition and may further minimize the possibility of breakage of bottle 14 when such impacts surface 16. Due to the fact that ring member 30 is deformable, deceleration forces on ring member 30 are substantially less than those forces acting on brittle and rigid bottle or container 14. Thus by the use of spillage prevention system 10, there is a decrease in the possibility of breakage of container 14 when such is dropped or otherwise impacts substantially horizontal surface 16.

Referring now to FIG. 4, there is shown an embodiment of spillage prevention system 10 where elevation device or ring element 30′ includes threaded members 44 formed on an internal surface of toroidal ring 30′. Cap member 20′ includes thread elements 46 which matingly engage ring threads 44. Thus, in this embodiment, ring member 30′ is adapted to threadedly engage or be secured to lateral wall 26′ of cap member 20′. This type of embodiment provides for a more secure fit between ring member 30′ and cap member 20′ than that previously shown and described, however, such requires more manufacturing adaptability applied to both of the cap member 20′ and ring member 30′.

A further embodiment of spillage prevention system 10 is shown in FIG. 5 where cap member 20″ includes a lateral wall arcuate contour in the shape of a pulley which is adapted to engage ring member 30 in a snap fit. Ring member 30 is deformable and thus insertable over opposing longitudinal diameters of cap member 20″ to fittingly engage cap member 20″ substantially as shown in FIG. 5. Once again, this type of securement provides a more permanent fastening of ring member 30 to cap member 20″ than is accomplished through a forced fit type of securement, however, manufacturing of embodiment cap member 20″ may have a somewhat higher manufacturing cost than provided by a force fit as has hereinbefore been described.

Still further, it can easily be seen from FIGS. 1–3 that ring member 30 and cap member 20 may be formed from one mold and thus formed in a one-piece construction. Where a non-releasable securement is desired between cap member 20 and ring member 30, adhesive securement may be applied to ring member 30 and a lateral wall 26 of cap member 20 to provide a unitary spillage prevention system 10.

Container spillage prevention system 10 as is herein shown and described, presents an effective method for maintaining liquid 12 within bottle 14 after container 14 has been dropped or otherwise located on a substantially horizontal surface 16 as shown in FIG. 2. However, system 10 has been shown to have a number of other uses in combination with the spillage prevention mechanism, for example, system 10 being adapted to be utilized as a child's teething ring, to provide a contamination resistant device to prevent nipple 18 from constantly contacting contaminates or surface 16 as well as to provide a shock resistant member to absorb impact loads when bottle or container 14 is dropped to surface 16.

While the invention has been described with certain specific embodiments thereof, it will now be understood that further modifications will suggest themselves to those skilled in the art and it is intended to cover such modifications within the scope of the appended claims.

What is claimed is:

1. A container spillage prevention system for material within said container, comprising:

a. a cap member adapted to matingly engage said container adjacent an open end of said container, said cap member having a through opening for securement thereto of a material dispensing element, said cap member having an external diameter defining a cap member lateral wall, said cap member having radially directed extension members formed on said lateral wall; and, b. means for elevating said material dispensing element a predetermined distance above a substantially horizontal surface, said elevation means being secured to said cap member lateral wall in deformable mating engagement with said extension members, said elevation means forming a doughnut shaped contour generated by a circle rotated about an axis in the plane of said circle, said elevation means having an external diameter substantially greater than a largest diameter of said container.

2. The container spillage prevention system as recited in claim 1 where said elevation means is formed of a pliable material for resiliently deforming when impact loaded.

3. The container spillage prevention system as recited in claim 2 where said elevation means is formed of a plastic material.

4. The container spillage prevention system as recited in claim 1 where said elevation means is releasably secured to said cap member throughout a peripheral boundary of said lateral wall of said cap member.

5. The container spillage prevention system as recited in claim 4 where said elevation means is threadedly secured to said lateral wall of said cap member, said radially directed extension members being threads.

6. The container spillage prevention system as recited in claim 4 where said cap member includes a lateral wall arcuate contour adapted to engage said ring member in a snap fit.

7. The container spillage prevention system as recited in claim 1 where said material dispensing element is a nipple.

8. The container spillage prevention system as recited in claim 7 where said container is a baby bottle.

* * * * *